US010597183B2

(12) United States Patent
Landolt et al.

(10) Patent No.: US 10,597,183 B2
(45) Date of Patent: Mar. 24, 2020

(54) APPARATUS FOR HEAT SHRINKING A PACKAGE AND METHOD FOR HEAT SHRINKING A PACKAGE

(71) Applicants: Stefan Landolt, Obernau (CH); Andre Steiner, Lucerne (CH)

(72) Inventors: Stefan Landolt, Obernau (CH); Andre Steiner, Lucerne (CH)

(73) Assignee: Cryovac, LLC, Charlotte, NC (US)

( * ) Notice: Subject to any disclaimer, the term of this patent is extended or adjusted under 35 U.S.C. 154(b) by 1541 days.

(21) Appl. No.: 14/376,159

(22) PCT Filed: Feb. 6, 2013

(86) PCT No.: PCT/EP2013/052260

§ 371 (c)(1),
(2) Date: Aug. 1, 2014

(87) PCT Pub. No.: WO2013/117556

PCT Pub. Date: Aug. 15, 2013

(65) Prior Publication Data

US 2015/0040520 A1 Feb. 12, 2015

(30) Foreign Application Priority Data

Feb. 7, 2012 (EP) ..... 12154247

(51) Int. Cl.

| | |
|---|---|
| ***B65B 53/00*** | (2006.01) |
| ***B65B 53/04*** | (2006.01) |
| ***F28D 21/00*** | (2006.01) |
| *B65B 53/06* | (2006.01) |

(52) U.S. Cl.
CPC ..... *B65B 53/04* (2013.01); *F28D 21/0014* (2013.01); *B65B 53/063* (2013.01)

(58) Field of Classification Search
CPC .. F28D 21/0012; F28D 21/0014; B65B 53/04
USPC ..... 53/441, 442, 557
See application file for complete search history.

(56) References Cited

U.S. PATENT DOCUMENTS

| | | | | |
|---|---|---|---|---|
| 3,763,620 | A * | 10/1973 | Giraudi | B65B 31/024 53/417 |
| 3,872,644 | A * | 3/1975 | Giraudi | B65B 57/14 53/168 |
| 3,978,874 | A * | 9/1976 | Schmidt, Sr. | B65B 53/04 134/107 |
| 5,193,290 | A * | 3/1993 | Tolson | B65B 53/02 34/216 |
| 5,400,570 | A | 3/1995 | Bennett | |

(Continued)

FOREIGN PATENT DOCUMENTS

| | | | |
|---|---|---|---|
| DE | 102006018330 | A1 | 10/2006 |
| EP | 1871673 | B1 | 9/2009 |

*Primary Examiner* — Chelsea E Stinson
(74) *Attorney, Agent, or Firm* — Jon M. Isaacson

(57) ABSTRACT

An apparatus for heat shrinking a package, comprising: a chamber configured such that a package on a surface of the apparatus may be heat shrunk via a heating fluid in the chamber; and a preheat container configured to supply a preheated liquid to a heat tank from which the heating fluid is supplied to the chamber; wherein the preheat container is above the surface such that liquid in the preheat container can be preheated by heat from the chamber.

13 Claims, 1 Drawing Sheet

(56) References Cited

U.S. PATENT DOCUMENTS

| | | | | |
|---|---|---|---|---|
| 5,699,650 | A * | 12/1997 | Gray | B65B 53/04 53/442 |
| 8,051,630 | B2 * | 11/2011 | Ehrmann | B65B 53/02 53/442 |
| 2009/0071107 | A1 * | 3/2009 | Ehrmann | B65B 53/02 53/442 |

* cited by examiner

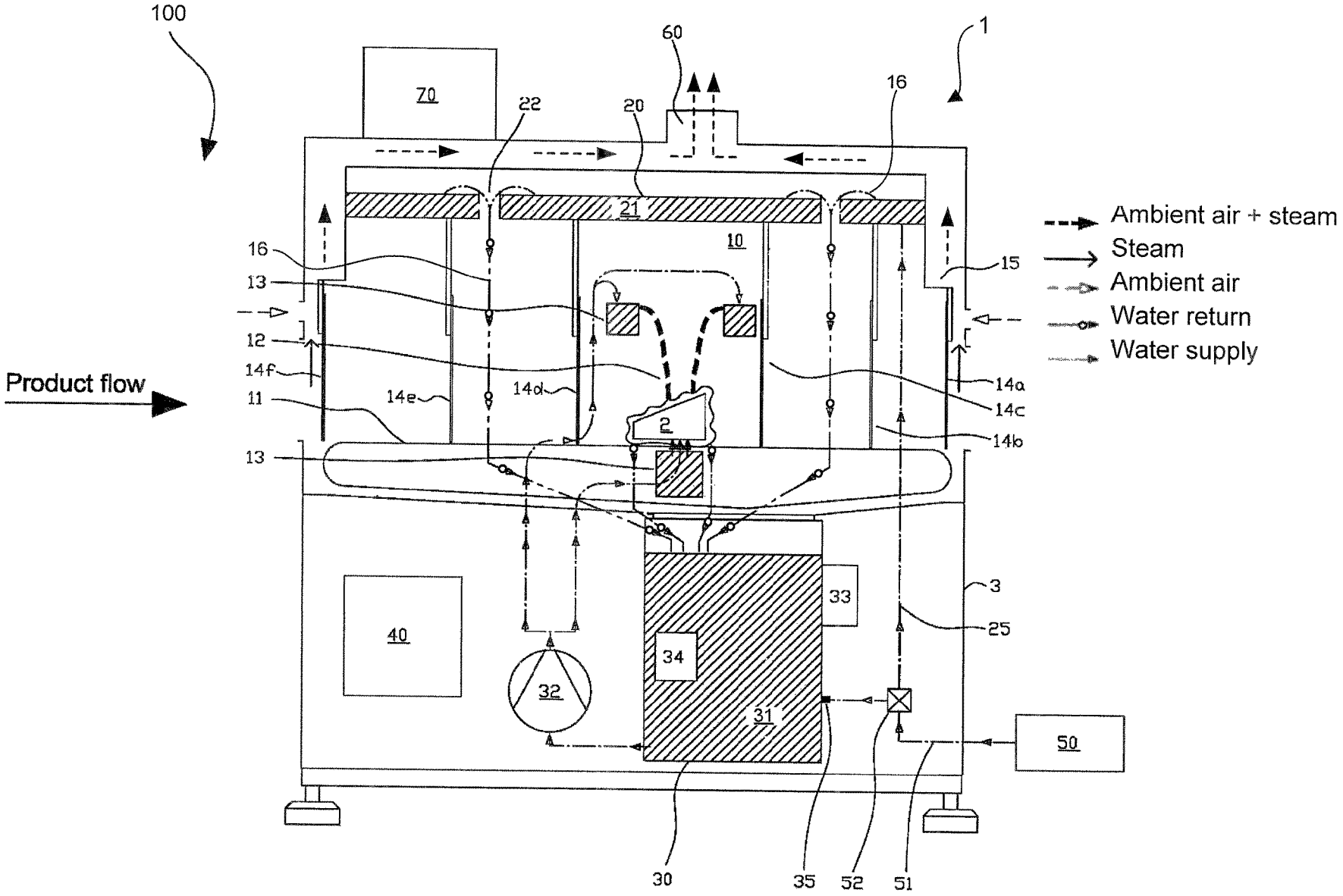
Ambient air + steam
Steam
Ambient air
Water return
Water supply
1
100
Product flow
10
11
12
13
14a
14b
14c
14d
14e
14f
15
16
20
21
22
25
30
31
32
33
34
35
40
50
51
52
60
70
2
3

APPARATUS FOR HEAT SHRINKING A PACKAGE AND METHOD FOR HEAT SHRINKING A PACKAGE

This application is a National Stage filing under 35 U.S.C. § 371 of International Application No. PCT/EP2013/052260, which has an international filing date of Feb. 6, 2013, and said International Application claims the benefit of European patent application serial no. 12154247.6 filed on Feb. 7, 2012.

TECHNICAL FIELD

The present invention relates to an apparatus for heat shrinking a package and a method for heat shrinking a package.

BACKGROUND ART

An apparatus for heat shrinking a package may be used to heat shrink a package. This process may be performed in the context or packaging foods such as meat and cheese. The food can be packaged in a heat shrinkable material. The material is shrunk around the food in the apparatus, which may be called a shrink tunnel or shrink tank. The purpose or the shrinking is to properly seal the package and to improve its appearance.

Such an apparatus may involve hot air being applied to the package, causing the material to shrink around the food. A problem with this method is that when packaging cold food products, shrinking stops once the material contacts the cold food. Such incomplete shrinking processes can result in a package which may not be sealed properly and/or which is aesthetically displeasing. In other such apparatuses, the package is subjected to immersion in a water bath or passage through a water curtain. The application of water can at least partly overcome the problem of the material stopping shrinking when coming into contact with a cold food product. However, immersion in water requires a large amount of energy, particularly in the initial stages of using the apparatus when the wafer must be heated to a high temperature (the water must also be subsequently maintained at a high temperature).

U.S. Pat. No. 5,400,570 discloses a method of heat shrinking a package in which both hot air and hot water are applied to the package. The hot air, which is at a higher temperature than the hot water, is used to heat the water. Meanwhile, US 2009/0071107 A1 discloses a system in which steam is extracted from the apparatus so as to recirculate its heat. However, such apparatuses require a relatively large amount of energy, particularly during the start-up phase or use of the apparatus.

An aim of the present invention is to provide an apparatus liar heat shrinking a package. Another aim is to provide a method for heat shrinking a package.

DISCLOSURE OF THE INVENTION

According to the invention, there is provided an apparatus for heat shrinking a package, comprising: a chamber con figured such that a package on a surface of the apparatus may be heat shrunk via a heating fluid in the chamber; and a preheat container configured to supply a preheated liquid to a heat tank from which the heating fluid is supplied to the chamber; wherein the preheat container is above the surface such that liquid in the preheat container can be preheated by heat from the chamber.

Accordingly, the present invention provides an apparatus for heat shrinking a package in an energy efficient way. In particular, by providing a preheat container, liquid can be preheated in the preheat container before entering the heat tank. This allows the temperature of the heat tank to be maintained at the necessary temperature using less energy, while still providing the required amount of additional liquid to the system to replace the used heating fluid.

In addition, by providing the preheat container above the surface on which the package is positioned, liquid in the preheat container can be preheated by heat from the chamber. This reuses heat from the system that would otherwise be wasted. The preheat container is close to the heat source in the chamber such that the liquid in the preheat container can be heated in an energy efficient way.

Optionally, the preheat container is above the chamber.

Accordingly, at least a large proportion of the heat in the chamber can be used to preheat liquid in the preheat container. The heat in the chamber rises upwards towards the preheat container so as to preheat the liquid in the preheat container. This provides a simple system for reusing the energy in the chamber.

Optionally, the preheat container is inside the chamber.

Accordingly, the preheat container can be very close to the heat source inside the chamber. This allows the liquid in the preheat container to be preheated efficiently. There can be very little energy loss as heat energy is transferred from the chamber to the preheat container because the preheat container is inside the chamber.

Optionally, the apparatus comprises at least one channel configured to produce water curtain inside the chamber, wherein the preheat container is above the at least one channel.

Accordingly, one or more partitioning curtains can be used to insulate the chamber from the colder outside environment. Additionally, one or more fluid (i.e., water) curtains can be used to apply heating fluid to the package in order to heat shrink it. By positioning the preheat container above the at least one channel, heat from the channel can rise upwards to the preheat container so as to preheat liquid in the preheat container. Accordingly, heat energy that could otherwise be wasted can be re-circulated in the system.

Optionally, the apparatus comprises the heat tank.

Accordingly, the apparatus is a compact machine. The machine merely requires an external supply of liquid and energy in order to function.

Optionally, the heat tank is below the surface such that gravity drives the movement of the preheated liquid from the preheat container to the heat tank.

Accordingly, there is a simple system for transferring preheated liquid from the preheat container to the heat tank. This provides a simple system that does not require any further device that could require energy in order to transfer the preheated liquid to the heat tank. This helps to reduce the energy consumption or the apparatus. By positioning the heat tank below the surface, excess heating fluid from any water curtain, for example, can flow back into the heat tank under gravity.

Optionally, the apparatus comprises a tank level monitor configured to monitor a level of heating fluid in the heat tank.

Accordingly, the fluid level in the heat tank can be monitored. This allows simple detection of the fluid requirements of the apparatus. Any variation in the fluid consumption rate or the apparatus can be quickly detected.

Optionally, the apparatus comprises a container level monitor configured to monitor a level of liquid in the preheat container.

Accordingly, the volume of liquid in the preheat container can be monitored.

Optionally, the apparatus comprises a controller configured to control a supply of an external liquid to the preheat container based on monitoring by the tank level monitor and/or the preheat container level monitor.

Accordingly, the apparatus can respond quickly to any variation in the fluid levels within the system. This can be used to ensure that a consistent volume of fluid is within circulation in the apparatus during operation.

Optionally, the preheat container comprises an opening through which the preheated liquid can overflow towards the heat tank.

Accordingly, the preheat container may have a simple design which allows the preheated liquid to be transferred to the heat tank in a simple manner. The use of the overflow opening can reduce the possibility that the volume of liquid in the preheat container exceeds a threshold value.

Optionally, the apparatus comprises an external liquid conduit configured to supply an external liquid to the preheat container, wherein an outer surface of the external liquid conduit is adjacent to or inside the chamber such that when the external liquid flows through the external liquid conduit the external liquid exchanges heat with heating fluid inside the chamber.

Accordingly, the supply of cold external liquid to the preheat container can have the effect of condensating vapour heating fluid inside the chamber. This can transform vapour heating fluid inside the chamber into heated liquid heating fluid, which can be re-circulated in the system.

Optionally, the apparatus comprises a controller configured to switch operation of the apparatus between a first mode in which an external liquid is supplied to the heat tank and not to the preheat container and a second mode in which an external liquid is supplied to the preheat container and not to the heat tank.

Accordingly, start-up time of the apparatus can be decreased by supplying external liquid directly to the heat tank during a warm-up phase of operation. Subsequently, the apparatus can be used in a production mode in which the external liquid is instead supplied to the preheat container for preheating so that it does not cool down the heating fluid in the heat tank.

Optionally, the apparatus comprises an extractor configured to extract vapour heating laid from the chamber and discharge it to an environment external to the apparatus.

Accordingly, the apparatus can have a simple design, which does not require any device to re-circulate steam extracted from the chamber. The vapour heating fluid extract from the chamber could be used in an application that is separate and independent from the heat shrinking apparatus.

Optionally, the surface is a surface of a conveyor belt configured to transport packages into and/or out from the chamber.

Accordingly, packages can be supplied continuously through the chamber for heat shrinking. The transportation of packages can be automated.

According to the invention, there is provided a method for heat shrinking a package, comprising: providing a package on a surface; preheating a liquid in a preheat container; supplying the preheated liquid to a heat tank from which a heating fluid is supplied to a chamber; and heat shrinking the package on the surface via the heating fluid in the chamber; wherein the preheat container is above the surface such that the liquid in the preheat container is preheated by heat from the chamber.

BRIEF DESCRIPTION OF THE DRAWINGS

FIG. 1 depicts an apparatus for heat shrinking a package according to an embodiment of the present invention.

MODE FOR THE INVENTION

FIG. 1 depicts an apparatus 1 for heat shrinking a package 2. The apparatus 1 comprises a chamber 10 and a preheat container 20. The chamber 10 is configured such that a package 2 on a surface 11 of the apparatus may be heat shrunk via a heating fluid in the chamber 10. The preheat container 20 is configured to supply a preheated liquid 21 to a heat tank 30 from which the heating fluid 31 is supplied to the chamber 10. The preheat container 20 is above the surface 11, in use, such that liquid in the preheat container 20 can be preheated by heat from the chamber 10. The preheat container 20 may be positioned such that the package 2 is between the surface 11 and the preheat container 20.

The present invention is a system for recovering heat that would otherwise be lost from circulation. By providing the preheat container 20 above the surface 11, heat energy from the chamber 10 can be used to preheat liquid in the preheat container 20 to form preheated liquid 21. The preheat container 20 is close to the source of energy in the chamber 10 that is used to preheat the liquid in the preheat container 20. As a result, there is very little energy loss in the transfer of energy from the chamber 10 to the liquid in the preheat container 20. The heating fluid 31 may be heated water and/or water vapour. Fluids other than water may also be used.

By positioning the preheat container 20 above the surface 11 on which the package 2 is positioned, in use, the apparatus 1 provides a simple way of re-circulating energy in the system. Excess heat energy in the chamber 10 is used directly to heat liquid in the preheat container 20, the preheated liquid 21 then being supplied to the heat tank 30 (e.g. by over flowing from the container 20 and moving under gravity to the heat tank 30 as illustrated in dashed lines 16) for supply back into the chamber 10 for the heat shrinking process.

In particular, other than the provision of the preheat container 20 itself, there is no need for any further devices in order to re-circulate energy within the system. Furthermore, by not requiring additional pipes, for example, extending around the apparatus 1 there is reduced possibility of heat being lost during the re-circulation process.

Heat is conducted from the chamber 10 to the preheat container 20. The heat is transferred by conduction. Heat is transferred by convection from the bottom of the chamber 10 to the preheat container 20.

Through experimentation, the inventors have found that provision of the preheat container 20 above the surface 11 results in a reduction in energy consumption of the apparatus 1 of at least 15%, preferably of at least 20% or more, for example of about 23% (e.g. from 32.5 kW/h to 25 kW/h).

The position of the preheat container 20 above the surface 11 is not particularly limited. In an embodiment, the preheat container 20 is directly above the surface 11. The term "directly above" means that when the apparatus 1 is in use, a vertical line connects the surface 11 to the preheat container 20, i.e. in plan view, the preheat container 20 at least partly overlaps the surface 11.

In an embodiment, the preheat container 20 is not directly above the surface 11. This means that in plan view there is no overlap between the preheat container 20 and the surface 11.

In an embodiment, the preheat container 20 is above the chamber 10. In this case, substantially all of the excess heat in the chamber 10 can rise upwards towards the preheat container 20 so as to preheat liquid inside the preheat container 20. Excess heat in the chamber 20 may be in the form of vapour heating fluid such as water vapour, for example. Such vapour heating fluid is not as effective as liquid heating fluid 31 for heat shrinking the package 2. In the present invention, the vapour heating fluid can be used by recirculating its energy in the system.

The preheat container 20 may or may not be directly above the chamber 10. In an embodiment the bottom surface of the preheat container 20 also forms a wall of the chamber 10. In the case that the preheat container 20 is not directly above the chamber, the preheat container 20 may be offset with respect to the chamber 10, namely to one side oldie chamber 10.

In an embodiment, the preheat container 20 may have the form of a tray that is, for example, substantially rectangular. In an embodiment the preheat container has the form of a trough that forms a shape in plan view. Desirably, the preheat container 20 is at least adjacent to the chamber 10. This reduces the amount of energy that is lost as it transfers from the chamber 10 to the preheat container 20.

In an embodiment, the preheat container 20 shares a boundary with the chamber 10. The preheat container 20 may be positioned on an upper surface of the chamber 10. In an embodiment, the preheat container 20 is adjacent to a side surface of the chamber 10. Desirably, the preheat container 20 is directly above the chamber 10 so as to make use of the natural upwards rise of heat in the chamber 10.

In an embodiment, the preheat container 20 is inside the chamber 10. In this case, energy loss during transfer from the chamber 10 to the preheat container 20 may be least reduced and possibly eradicated. The excess heat in the chamber 10 can help to maintain the temperature of the preheated liquid 21 in the preheat container 20. By positioning the preheat container 20 inside the chamber 10, the preheat container 10 may absorb heat room the chamber 10 on all sides of the preheat container 20. In particular, in addition to receiving heat from the chamber 10 through the bottom surface or the preheat container 20, heat can also be received through the top surface and/or one or more side surfaces of the preheat container 20.

The position of the preheat container 20 inside the chamber 10 is not particularly limited. Desirably, the preheat container 20 is kept out of the way of other components inside the chamber 10.

In an embodiment the preheat container has a capacity or at least 20 l, optionally at least 40 l and preferably at least 60 l.

In an embodiment the apparatus 1 comprises at least one channel configured to produce at least a water curtain 12 inside the chamber 10. In an embodiment the preheat container 20 is above the at least one channel.

A water curtain 12 is formed from liquid that falls under gravity from a channel through which the liquid flows. The liquid can be water but this is not necessarily the case. The type or liquid that forms the water curtain 12 is not particularly limited.

The water curtain 12 may be formed by liquid falling out of a container filled by water from the heat tank and is used to heat shrink the package 2.

One or more partitioning curtains 14*a-f*, such as silicon curtains (i.e. a plurality of sheets of polymer, optionally partially overlapped), may be provided to partition off a section of the chamber 10 from the outside environment. The partitioning curtains 14*a-f* thermally insulate the interior or the chamber 10 from the exterior of the chamber 10. There may be a substantial temperature difference between the interior of the chamber 10 and the exterior of the chamber 10. For example, in an embodiment the interior of the chamber 10 is maintained at a temperature within the range of from about 75° C. to about 100° C. and preferably within the range of from about 87° C. to about 92° C. On the other hand, in an embodiment the environment external to the apparatus 1 may be at a temperature of less than 30° C., optionally less than 20° C. and optionally about 10° C., The colder temperature outside of the apparatus 1 may help to preserve the foodstuff inside the package 2.

In addition to providing insulation, the partitioning curtains 14*a-f* allow the package 2 to pass through the partitioning curtains 14*a-f* when the package 2 is transported into and/or out horn the chamber 10. When the package 2 passes through the partitioning curtains 14*a-f*, the package 2 disrupts the partitioning curtains 14*a-f* only at the point at which the package 2 comes into contact with the partitioning curtains 14*a-f*. The remainder of the partitioning curtains 14*a-f* that does not come into contact with the package 2 continues to insulate the interior of the chamber 10 from the exterior of the chamber 10.

In an embodiment the apparatus 1 comprises at least two partitioning curtains 14*e*, 14*d* inside the chamber 10 through which the package 2 passes when the package 2 is transported into the chamber 10, and at least two partitioning curtains 14*b*, 14*c* inside the chamber 10 through which the package 2 passes when the package 2 is transported out from the chamber 10. Both the entrance and exit of the chamber 10 may comprise further partitioning curtains 14*f*, 14*a* to provide insulation from the external environment. As depicted in FIG. 1, in an embodiment the apparatus 1 comprises at least three partitioning curtains 14*f*, 14*e*, 14*d* on an inlet side and/or at least three partitioning curtains 14*c*, 14*b*, 14*a* on an outlet side of the chamber 10. This produces double or triple curtains on both sides of the chamber 10. This reduces the quantity of vapour heating fluid which can move from the interior of the chamber 10 to the exterior of the chamber 10.

FIG. 1 depicts another type of water curtain 12 which flows from a channel in the chamber 10. In the centre of the chamber 10 depicted in FIG. 1, a pair of water curtains 12 are provided for applying liquid heating fluid 31 to the package 2 so as to heat shrink the package 2. The water curtains 12 flow from low pressure distributor channels. The driving force for the water curtains 12 is gravity. This helps to create a smoothly flowing water curtain 12.

The package 2 is transported into the chamber 10 onto the surface 11. When the package 2 reaches the water curtains 12 in the central region of the chamber 10, the package 2 is subjected to the application of liquid heating fluid 31 by the central water curtains 12. This causes the shrinkable packaging material surrounding the foodstuff to shrink around the foodstuff, thereby shrinking the package 2. After shrinking, the package 2 is transported out from the chamber 10.

As mentioned above, in an embodiment the preheat container 20 is above the at least one channel. An advantage of this is that heat from the channel can rise upwards towards the preheat container 20 so as to preheat liquid in the preheat container 20. Accordingly, heat energy that would otherwise be wasted can be re-circulated in the system. The liquid that flows through the channels to form the water curtains 12 comprises liquid heating fluid 31. The liquid that forms the water curtains 12 is heated such that the water curtains 12 do not cause the temperature inside the chamber 10 to be reduced. Instead the water curtains 12 help to maintain the temperature inside the chamber 10.

At the points in the channels where the liquid heating fluid 31 falls under gravity to form the water curtains 12, vapour heating fluid can be formed and can rise upwards. This can in principle result in the heat from the vapour heating fluid being lost from the system. In an embodiment of the present invention, the vapour heating fluid comes into contact with the preheat container 20 so as to transfer heat to the preheat container 20. In this way the heat from the vapour heating fluid is re-circulated and retained in the system.

The presence of water curtains 12 is not necessary for the present invention to function. For example, heating fluid 31 can be applied to the package 2 by different means other than water curtains 12. In an embodiment, means for applying heating fluid 31 to the package 2 comprises at least one spray head 13, which may comprise a nozzle. The spray head 13 sprays heating fluid 31 onto the package 2. In an embodiment one or more spray heads 13 may be positioned above the surface 11 and are configured to spray heating fluid 31 downwards towards the package 2. In an embodiment one or more spray heads 13 are positioned below the surface 11 and are configured to spray heating fluid 31 upwards towards the package 2, as illustrated in FIG. 1.

In an embodiment the apparatus 1 comprises the heat tank 30 from which the heating fluid 31 is supplied to the chamber 10. All advantage of this is that the apparatus 1 may be particularly compact. In this case, the apparatus 1 may merely require an external supply of liquid and energy in order to operate properly.

In an embodiment the heat tank 30 has a capacity of at least 50 l, optionally at least 75 l and preferably at least 100 l. For example the heat tank 30 may have a capacity of approximately 120 l and the preheat container 20 or approximately 8-12 l.

During operation of the apparatus 1, heating fluid 31 is consumed. For example, heating fluid may remain on the package 2 when the package 2 exits from the apparatus 1. Additionally or alternatively, heating fluid may be lost as vapour heating fluid that escapes through the sides (as illustrated by the solid arrow pointing upwards on the outside of the partitioning curtains 14*a* and 14*f* and/or out from the top of the chamber 10 or the apparatus 1. The rate of consumption of heating fluid in use to heat shrink products 2 may be in the range of from about 60 l/h to about 180 l/h, for example.

As depicted in FIG. 1, in an embodiment the heat tank 30 is positioned below the surface 11. The heat tank 30 may be positioned within the same housing unit 3 as the chamber 10. However, this needs not necessarily be the case. For example, the heat tank 30 can be provided as a separate unit from the apparatus 1 that comprises the chamber 10. The heat tank 30 is in fluid communication with the chamber 10 such that the heating fluid 31 can be supplied from the heat tank 30 to the chamber 10, for example via a water curtain 12 and/or a spray head 13.

In an embodiment the heat tank 30 comprises one or more heating units configured to heat liquid inside the heat tank 30. The heating units are not particularly limited and may be of any type suitable for heating liquid inside a container. The heating units may be powered by electrical energy, for example.

As a result of the energy savings made by the presence of the preheat container 20 in the apparatus 1 according to the present invention, the heat tank 30 can comprise fewer heating units than corresponding apparatuses 1 that do not have the preheat container 20 system.

In an embodiment the apparatus 1 comprises a pump 32 configured to pump heating fluid 31 from the heat tank 30 to the chamber 10. The pump 32 may be powered by electrical energy, for example. In an embodiment the pump 32 is positioned within the housing unit 3 that comprises the chamber 10.

In an embodiment the apparatus 1 comprises a controller 40 configured to control operations of the apparatus 1. For example, in an embodiment the controller 40 is configured to control the supply of heating fluid 31 from the heat tank 30 to the chamber 10. The controller 40 may control the pump 32 so as to supply appropriately the heating fluid 31 to the chamber 10. As depicted in FIG. 1, in an embodiment the controller 40 is provided in the housing unit 3 that comprises the chamber 10. However, this needs not necessarily be the case. In an embodiment the controller 40 is provided as a separate unit from the housing unit 3 of the apparatus 1.

As depicted in FIG. 1, in an embodiment the heat tank 30 is below the surface 11 such that gravity drives the movement of the preheated liquid from the preheat container 20 to the heat tank 30. An advantage of providing the heat tank 30 below the surface 11 is that the resulting system is simple and allows the preheated liquid 21 to transfer efficiently from the preheat container 20 to the heat tank 30. This simple system does not require any further device that could require additional energy in order to transfer the preheated liquid to the heat tank 30. This helps to reduce the energy consumption of the apparatus 1.

Additionally, by positioning the heat tank 30 below the surface 11, excess heating fluid 31 within the chamber 10 can flow downwards into the heat tank 30 under gravity. For example, heating fluid 31 that has been used by a water curtain 12 can row hack into the heat tank 30 efficiently. This helps to reduce the amount of heat that is lost from the heating fluid 31 between the time that it is used in the chamber 10, e.g. in a water curtain 12 and the time that it is received into the heating tank 30. Otherwise, excess vapour heating fluid can be given off by the liquid heating fluid 31 in the chamber 10, which can be lost in the system. Of course, the present invention provides a way of minimizing this lost heat by using the vapour heating fluid inside the chamber 10 to preheat liquid inside the preheat container 20.

In an embodiment the apparatus 1 comprises a tank level monitor 33 configured to monitor a level of heating fluid 31 in the heat tank 30. The type of monitor used for the tank level monitor 33 is not particularly limited. The tank level monitor 33 may comprise any monitor suitable for monitoring the level of heating fluid 31 in the heat tank 30. In an embodiment the tank level monitor 33 provides a monitoring result to the controller 40. The monitoring result is indicative the level of heating fluid 31 in the heat tank 30.

An advantage of the tank level monitor 33 is that it allows simple detection of the fluid requirement of the apparatus 1. For example, any variation in the fluid consumption rate of the apparatus 1 can be quickly detected. Such a variation in the fluid consumption rate of the apparatus 1 could be indicative of a system fault, for example. As such rapid detection of any variation in the fluid consumption rate of the apparatus 1 is desirable.

In an embodiment the controller 40 is configured to raise an alarm signal when the fluid consumption rate of the apparatus 1 falls below a predetermined threshold and/or rises above a predetermined threshold. The alarm signal may be visual, for example on a display of the apparatus 1, and/or may be audible.

In an embodiment the apparatus 1 may comprise a container level monitor configured to monitor a level of liquid in the preheat container 20. The liquid may be preheated liquid 21. The container level monitor comprises any monitor suitable for monitoring the level of liquid in a container. In an embodiment the container level monitor provides a container monitoring result to the controller 40. The container monitoring result is indicative of the level of liquid in the preheat container 20.

The container level monitor allows the volume of liquid in the preheat container 20 to be monitored. This allows any undesirable variations in the volume of liquid inside the preheat container 20 to be detected quickly. For example, the container level monitor 23 can detect wizen the volume of liquid undesirably increases, which may be indicative of a blockage preventing the preheated liquid 21 from transferring from the preheat container 20 to the heat tank 30. Additionally the container level monitor can detect if the volume of liquid undesirably decreases, which may be indicative of a defect in the preheat container 20 allowing extra preheated liquid 21 to exit the preheat container 20. In an embodiment the controller 40 is configured to raise an alarm signal when the level of liquid in the preheat container 20 falls below a predetermined threshold or rises above a predetermined threshold.

A container level monitor configured to monitor the level of liquid in the preheat container 20 may not be necessary. As any excess liquid in the preheat container 20 is allowed to overflow, the total amount of liquid in the system can be determined by sensor 33. In an embodiment the controller 40 is configured to control a supply of an external liquid to the preheat container 20 based on monitoring by the tank level monitor 33 and/or a container level monitor. For example, the controller 40 can control the apparatus 1 such that the level of heating fluid 31 in the heat tank 30 is maintained at an approximately constant level when the apparatus 1 is in production mode. The controller 40 may be configured to maintain the level of heating fluid 31 inside the heat tank 30 at a target threshold level. When the tank level monitor 33 monitors that the level of heating fluid 31 in the heat tank 30 is below the target threshold level, the controller 40 may control the supply of an external liquid to the preheat container 20 to increase in rate. When the tank level monitor 33 monitors that the level of heating fluid 31 in the heat tank 30 is above the target threshold level, then the controller 41 may control the supply of external liquid to the preheat container 20 to decrease in rate.

The rate of supply of external liquid to the preheat container 20 may be directly related to the rate at which preheated liquid 21 is supplied from the preheat container 20 to the heat tank 30. In this way, the level of heating fluid 31 in the heat tank 30 can be maintained at an approximately constant level.

Other configurations are possible for the controller 40 to control the supply of external liquid. For example, in an embodiment the controller 40 increases the supply rate of external liquid to the preheat container 20 when a container level monitor monitors that the level of liquid in the preheat container is below a target threshold level. The controller 40 may be configured to decrease the supply rate of external liquid to the preheat container 20 when a container level monitor monitors that the level of liquid in the preheat container 20 is above a target threshold level.

An advantage of the controller 40 controlling the supply of external liquid to the preheat container 20 based on the monitoring by the tank level monitor 33 and/or a container level monitor is that the apparatus 1 can respond quickly to any variation in the fluid levels within the system. Accordingly, it can be ensured that a consistent volume of fluid is used within the circulation of the apparatus 1 during operation in the production mode. This helps to maintain a consistent temperature within the chamber 10.

In an embodiment the preheat container 20 comprises an opening 22 through which the preheated liquid 21 can overflow towards the heat tank 30. As depicted in FIG. 1, the preheat container 20 may lake the form of a container being open at its upper end. The preheated liquid 21 can overflow over the edges of the preheat container 20. In FIG. 1, the overflow 16 of preheated liquid 21 from the preheat container 20 is depicted in a broken line with one long dash separated by two short clashes with arrows. The arrows comprise a circle behind an arrowhead shape.

In an embodiment the preheat container 20 is substantially fully open at its upper end. However, this need not necessarily be the case. For example, the preheat container 20 may be partially covered at its upper end. An advantage of such a partial covering is that it can reduce the amount of heat that escapes from the surface of the preheated liquid 21 in the preheat container 20 before it is transferred to the heat tank 30.

The overflow through the opening 22 allows the preheat container 20 to have a simple design which allows the preheated liquid 21 to be transferred to the heat tank 30 in a simple manner. The use of the overflow opening 22 can ensure that the volume of liquid in the preheat container 20 does not exceed a threshold value.

The opening 22 does not have to be at the upper end of the container. In an embodiment the opening 22 is formed within the side of the preheat container 20, for example.

The liquid inside the preheat container 20 is preferably preheated to a temperature that is greater than the temperature of external liquid entering the system but less than the temperature of the heating fluid 31 inside the heat tank 30. For example the preheated liquid 21 inside the preheat container 20 may be at a temperature of about 60° C.

In an embodiment the heat tank 30 comprises a tank thermometer 34 configured to measure a temperature of heating fluid 31 inside the heat tank 30. The tank thermometer 31 may be configured to provide a temperature measurement to the controller 40. In an embodiment the controller 40 controls the heating units inside the heat tank 30 depending on the temperature measurements from the tank thermometer 34. This can help to keep the temperature of the heating fluid 31 inside the heat tank 30 at a consistent temperature.

In an embodiment the apparatus 1 comprises an external liquid conduit 25. The external liquid conduit 25 is configured to supply an external liquid to the preheat container 20. The external liquid may be at a temperature that is lower than the temperature at which the interior of the chamber 10 is maintained. For example, the chamber 10 may be maintained at a temperature or approximately 87° C. to 92° C., whereas the external liquid may have a temperature or about 10° C.

In art embodiment an outer surface of the external liquid conduit 25 is adjacent to or inside the chamber 10 such that when the external liquid flows through the external liquid conduit 25 the external liquid exchanges heat with heating fluid 31 inside the chamber 10. In the embodiment depicted in FIG. 1, the external liquid conduit 25 extends inside the chamber 10.

Vapour heating fluid which escapes from inside the chamber 10 (e.g. through partitioning curtains) may come into contact with the outer surface of the external liquid conduit 25. If the external liquid conduit 25 is outside but adjacent to the chamber 10, the vapour heating fluid in the chamber 10 may transfer heat to the external liquid conduit 25.

The external liquid conduit 25 acts to condensate vapour heating fluid inside the chamber 10 into liquid heating fluid 31. The condensated liquid heating fluid 31 can then be transferred under gravity back into the heat tank 30, in this way, the vapour heating fluid can be re-circulated back into the system instead or being wasted.

This reduces the loss of vapour heating fluid, such as water vapour, from the chamber 10. Such vapour heating fluid can otherwise be lost through the inlet and/or outlet ends of the chamber 10. Even in the case that partitioning curtains 14*a-f* are used to insulate the interior of the chamber 10 from the exterior of the chamber 10, an amount of vapour heating fluid can escape through the partitioning curtains 14*a-f*. This is particularly the ease when the package 2 is passing through the partitioning curtains 14*a-f*.

In an embodiment the apparatus 1 comprises one or more channels 15 configured to allow external gas to enter into the chamber 10. The external gas is gas such as air from the environment immediately external to the apparatus 1. This external gas may be at a significantly lower temperature compared to the temperature inside the chamber 10. The purpose of the channels 15 is to allow the colder external gas (depicted by dashed lines a constant length) to condensate the vapour heating fluid inside the chamber 10 into liquid heating fluid 31 that can be re-circulated in the system back into the heat tank 30. As depicted in FIG. 1, the at least one channel 15 may be positioned al a side of the chamber 10. The at least one channel may be positioned at an inlet end and/or at an outlet end of the chamber 10. The at least one channel 15 may extend vertically lengthwise along a section of the chamber 10. In the Figures the dotted lines depict the flow of external gas mixed with steam into the apparatus 1.

In an embodiment the controller 40 is configured to switch operation of the apparatus 1 between a first mode in which an external liquid is supplied to the heat tank 30 and not to the preheat container 20 and a second mode in which an external liquid is supplied to the preheat container 20 and not to the heat tank 30. The apparatus 1 has at least two modes of operation.

The firm mode of operation may be used during a warm-up phase of operation of the apparatus 1. For example, before the warm-up phase, die heat tank 30 may be substantially empty, and/or any liquid inside the heat tank 30 may be unheated such that it is at substantially the same temperature as the external environment of the apparatus 1, or at least less than the temperature at which the chamber 10 is to be maintained. For the warm-up phase, the controller 40 switches operation of the apparatus 1 to the first mode. External liquid is supplied directly to the heat tank 30. In the first mode the preheat container 20 may be bypassed.

This allows the external liquid to be heated directly in the heat tank 30. This is desirable because the heating unit inside the heat tank 30 may be more powerful than the effect of heating of the preheat container 20 by heat within the chamber 10. This allows the external liquid to be heated more quickly to the target temperature at which the chamber 10 is to be maintained. Once a target threshold level of heating liquid 31 has been healed to the desired temperature within the heat tank, the controller 40 may switch operation of the apparatus 1 from the first mode to the second mode of operation. The tank thermometer 34 may indicate when the target temperature has been readied. The tank level monitor 33 may indicate when the target threshold level has been reached within the heat tank 30.

In the second mode the external liquid is supplied to the preheat container 20. For example, the external liquid may be supplied to the preheat container 20 through the external liquid conduit 25. In the second mode the external liquid is not supplied to the heat tank 30 directly. This helps to avoid reduction in the temperature of the heating fluid 31 in the heat tank 30 due to the lower temperature of the external liquid. Instead, the external liquid is supplied to the preheat container 20 where it is preheated, the preheated liquid 21 then being supplied to the heat tank 30.

As depicted in FIG. 1, external liquid may be supplied from an external liquid source 50 to the apparatus 1 via a source conduit 51. The apparatus 1 may comprise a tank conduit 35 configured to transport external liquid from the source conduit 51 to the heat tank 30 directly. The external liquid conduit 25 is configured to transport the external liquid from the source conduit 51 to the preheat container 20 directly. A valve 52 may be provided to switch whether the external liquid flows from the source conduit 51 to the tank conduit 35 or from the source conduit 51 to the external liquid conduit 25. In an embodiment the controller 40 controls the valve 52 so as to switch the operation of the apparatus 1 between the first mode and the second mode. The second mode may be termed the production mode of the apparatus 1.

In an embodiment the apparatus 1 comprises an extractor 60 configured to extract vapour heating fluid ire m the chamber 10. In an embodiment the extractor 60 is configured to discharge the extracted vapour heating fluid to an environment external to the apparatus 1.

Hence, the apparatus 1 can have a simple design and does not require any device to re-circulate, for example, water vapour or steam that is extracted from the chamber 10. The vapour heating fluid extracted from the chamber 10 could be used in an application that is separate and independent from the heating shrinking apparatus 1.

However, in an embodiment the vapour heating fluid extracted from the chamber 10 by the extractor 60 can be re-circulated within the apparatus 1. This makes use of heat that may otherwise be lost from the system by re-circulating it within the system. For example, the extracted vapour heating fluid can be condensated into warm liquid that is then ready to be re-circulated back into the heat tank 30.

In an embodiment the surface 11 is a surface of a conveyor belt configured to transport packages into and/or out from the chamber 10. Accordingly, packages 2 can be supplied continuously through the chamber 10 for heat shrinking. The transportation of the packages 10 can be automated.

In an embodiment the surface 11 comprises holes and/or is porous such that liquid heating fluid 31 in the chamber 10 can pass through the surface 11. The conveyor belt may comprise a mesh surface. This allows the excess liquid heating fluid 31 to pass back into the heat tank so as to be re-circulated within the system.

In an embodiment the apparatus 1 forms a part of a packaging system 100. The packaging system 100 may comprise a dryer (not illustrated) configured to dry packages 2 that have been heat shrunk by the apparatus 1 for heat shrinking packages 2. In an embodiment the dryer is configured to blow gas onto the package 2 so as to dry the package 2. The gas may be air, for example. The gas may be heated. The dryer can dry packages 2 that have heating fluid 31 remaining on them from the apparatus 1.

In an embodiment the apparatus 1 comprises a control panel 70. The control panel 70 is configured to allow a user to input commands into the apparatus 1. The control panel 70 may be connected to the controller 40 such that a user can control the controller 40. The control panel 70 may comprise a display. The control panel 70 may comprise a touch display. The control panel may comprise push buttons.

The invention claimed is:

1. An apparatus for heat shrinking a package, comprising:

a chamber configured such that a package on a surface of the apparatus may be heat shrunk via a heating fluid in the chamber; and a preheat container configured to supply a preheated liquid to a heat tank from which the heating fluid is supplied to the chamber;

wherein the preheat container is above said surface such that liquid in the preheat container can be preheated by heat from the chamber; and wherein the preheat container is positioned on an upper surface of the chamber and directly above the chamber such that the preheated liquid is preheated above the chamber by heat rising upward in the chamber.

2. The apparatus of claim 1, comprising at least one channel configured to produce a water curtain inside the chamber, wherein the preheat container is above the at least one channel.

3. The apparatus of claim 1, wherein the heat tank is below the surface such that gravity drives the movement of the preheated liquid from the preheat container to the heat tank.

4. The apparatus of claim 3, comprising a tank level monitor configured to monitor a level of heating fluid in the heat tank.

5. The apparatus of claim 4, comprising a controller configured to control a supply of an external liquid to the preheat container based on monitoring by the tank level monitor.

6. The apparatus of claim 1, comprising a container level monitor configured to monitor a level of liquid in the preheat container.

7. The apparatus of claim 1, wherein the preheat container comprises an opening through which the preheated liquid can overflow towards the heat tank.

8. The apparatus of claim 1, comprising an external liquid conduit configured to supply an external liquid to the preheat container, wherein an outer surface of the external liquid conduit is adjacent to or inside the chamber such that when the external liquid flows through the external liquid conduit the external liquid exchanges heat with heating fluid inside the chamber.

9. The apparatus of claim 1, comprising a controller configured to switch operation of the apparatus between a first mode in which an external liquid is supplied to the heat tank and not to the preheat container and a second mode in which an external liquid is supplied to the preheat container and not to the heat tank.

10. The apparatus of claim 1, comprising an extractor configured to extract vapor heating fluid from the chamber and discharge it to an environment external to the apparatus.

11. The apparatus of claim 1, wherein the surface is a surface of a conveyor belt configured to transport packages into and/or out from the chamber.

12. A method for heat shrinking a package, comprising:

providing a package on a surface;

preheating a liquid in a preheat container;

supplying the preheated liquid to a heat tank from which a heating fluid is supplied to a chamber; and heat shrinking the package on the surface via the heating fluid in the chamber;

wherein the preheat container is above the surface such that the liquid in the preheat container can be preheated by heat from the chamber; and wherein the preheat container is positioned on an upper surface of the chamber and directly above the chamber such that the preheated liquid is preheated above the chamber by heat rising upward in the chamber.

13. The apparatus of claim 6, comprising a controller configured to control a supply of an external liquid to the preheat container based on monitoring by the container level monitor.

* * * * *